US006464093B1

(12) United States Patent
Takano

(10) Patent No.: US 6,464,093 B1
(45) **Date of Patent: *Oct. 15, 2002**

(54) PILFER-PROOF CAP

(75) Inventor: Takafusa Takano, Itami (JP)

(73) Assignee: Yamamura Glass Co., Ltd., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/575,836

(22) Filed: May 18, 2000

Related U.S. Application Data

(63) Continuation of application No. 08/738,176, filed on Oct. 28, 1996, now Pat. No. 6,109,464, which is a continuation of application No. 08/277,882, filed on Jul. 20, 1994, now abandoned.

(30) Foreign Application Priority Data

Jul. 21, 1993 (JP) ..... 5-201904

(51) Int. Cl.[7] ..... B65D 41/34
(52) U.S. Cl. ..... 215/252
(58) Field of Search ..... 215/252, 258

(56) References Cited

U.S. PATENT DOCUMENTS

| | | | | |
|---|---|---|---|---|
| 2,362,421 A | | 11/1944 | Von Till | |
| 4,478,343 A | | 10/1984 | Ostrowsky | |
| 4,546,892 A | | 10/1985 | Couput | |
| 4,550,844 A | | 11/1985 | Lininger | |
| 4,657,153 A | | 4/1987 | Hayes | |
| 4,801,030 A | | 1/1989 | Barriac | |
| 4,801,031 A | | 1/1989 | Barriac | |
| 4,807,771 A | | 2/1989 | Roy et al. | |
| 4,813,561 A | | 3/1989 | Ochs | |
| 4,848,614 A | | 7/1989 | Csaszar | |
| 4,981,230 A | | 1/1991 | Marshall et al. | |
| 5,007,545 A | | 4/1991 | Imbery, Jr. | |
| 5,050,753 A | | 9/1991 | Trump et al. | |
| 5,058,755 A | | 10/1991 | Hayes | |
| 5,080,246 A | | 1/1992 | Hayes | |
| 5,129,530 A | | 7/1992 | Fuchs | |
| 5,400,913 A | * | 3/1995 | Kelly | 215/252 |
| 5,570,798 A | * | 11/1996 | Hayashida et al. | 215/252 |
| 5,775,527 A | * | 7/1998 | Bosl et al. | 215/252 |
| 5,779,075 A | * | 7/1998 | Salmon et al. | 215/252 |
| 6,109,464 A | * | 8/2000 | Takano | 215/252 |

FOREIGN PATENT DOCUMENTS

| | | |
|---|---|---|
| AU | B-34692/89 | 11/1989 |
| DE | 58901671 G | 7/1992 |
| EP | 343 102 A2 | 11/1989 |
| EP | 390 412 | 10/1990 |
| GB | 2 199 571 A | 7/1988 |
| JP | 1-182259 | 7/1989 |
| JP | 3-11985 | 1/1991 |
| WO | WO 94/14673 | 7/1994 |

* cited by examiner

*Primary Examiner*—Lee Young
*Assistant Examiner*—Robin A. Hylton
(74) *Attorney, Agent, or Firm*—Seed Intellectual Property Law Group PLLC

(57) ABSTRACT

A pilfer-proof plastic cap for sealing containers. The cap comprises a cap body, a band member and an annular wall extending upwardly and radially inward from the band member. A plurality of stopper tabs formed in the annular wall is engagable with the threads of a threadably capped container. The stopper tabs have a saw-tooth shape including a mildly inclined leading surface for smooth engagement of the cap with the container threads. The band member is connected to the cap with breakable ridges to indicate tampering. The band itself contains a breakable ridge to ease removal of the band from the container.

3 Claims, 6 Drawing Sheets

PILFER-PROOF CAP

CROSS-REFERENCE TO RELATED APPLICATION

This application is a continuation of U.S. patent application Ser. No. 08/738,176, filed Oct. 28, 1996, U.S. Pat. No. 6,109,464, which is a file wrapper continuation of U.S patent application Ser. No. 08/277,882, filed Jul. 20, 1994, now abandoned.

Background of the Invention

1. Field of the Invention

The present invention relates to a plastic cap incorporating pilfer-proof function.

2. Description of the Related Art

As is disclosed in U.S. Pat. No. 4,550,844 for example, any of those conventional plastic-molded pilfer-proof caps have a cap skirt and a band member which are integrated by means of a plurality of frangible bridges. More than 10 stopper tabs are formed on an internal wall surface of the band member by way of projecting themselves in the obliquely downward direction. When screwing the cap skirt on the bottle mouth, the stopper tabs come into contact with a bead member extending outwardly in the periphery of the bottle mouth, and then reversely bend in the obliquely upward direction. Then, while maintaining the bent condition, the stopper tabs climb over the bead member before eventually being engaged with the bottom surface thereof to prevent the band member from being lifted while opening the bottle. Each of the stopper tabs is thin at the bent end. However, the nearer the projected end, the greater the thickness of each stopper tab.

Japanese Patent Publication No. HEI3-11985 (1991) discloses a pilfer-proof cap. This prior art discloses a plurality of stopper tabs on the internal wall surface of a band member, and the stopper tabs extend in the obliquely upward direction. Like the above example, nearer the bent end, each of these stopper tabs has a thinner surface wall. This is because of the need to minimize transit resistance while the stopper tabs climb over the bead member. Excessive transit resistance causes bridges to easily be torn off while screwing the cap on the bottle mouth.

The applicant for a patent related to the present invention previously proposed a pilfer-proof cap via Japanese Laid-Open Patent Application Publication No. HEI1-182259 (1989), which provides a plurality of stopper tabs projecting from the bottom edge of a band member in the obliquely upward direction, wherein a surface wall of each stopper tab is bent in a chevron shape in a sectional view.

Each of the stopper tabs has a surface wall that is thin at the refracted end and thicker in the direction of the projected end, and the transit resistance of these stopper tabs can be minimized when climbing over the bead member on a bottle mouth. On the other hand, there is a problem in terms of the retentive force of the band member while opening the bottle cap. Accordingly, while the band member is pulled in the upward direction relative to a cap opening operation, the refracted ends and projected tips of the stopper tabs respectively bend downwardly. As a result, the band member shifts upward by such an amount corresponding to the degree of deformation incurred. In an extreme case, the band member is fully disengaged from the secured position.

If the stopper tabs were incapable of sustaining enough engaging force, even though the sealed bottles were opened out of mischief while being displayed, nobody could visually identify the earlier opening of the bottles. When the band member shifts upwardly, the seal of the cap leaves the bottle mouth before the bridges are torn off, thus resulting in the faulty effect of sealing. If this symptom occurs in a bottle containing a carbonated beverage, carbonic acid gas will be lost. Unless the bridges are torn off, dissipation of carbonic acid gas cannot be identified.

In order to provide stopper tabs with greater engaging force, for example, by increasing the thickness of the bent ends of the stopper tabs, the change would result in an increased transit resistance while the stopper tabs climb over the bead member as the cap is screwed on the bottle mouth. If excessive force were applied in order to screw the cap on the bottle mouth, the bridges could be torn off.

As is apparent from the above, it is a matter of contradiction to minimize the transit resistance while the stopper tabs respectively climb over the bead member while capping a bottle and simultaneously provide the stopper tabs with greater engaging force while opening the bottle.

On the other hand, according to the cap having the surface walls of the stopper tabs that are folded in the chevron shape, the surface walls of the stopper tabs are provided with greater buckling strength than that of conventional, plane-shaped stopper tabs, thus permitting the chevron-shaped stopper tabs to more securely retain the band member. However, like the above-cited conventional cap, the previously proposed cap is also provided with a number of independent stopper tabs on the internal surface of the band member. In consequence, these stopper tabs bend themselves inwardly or downwardly while opening a bottle thereby causing the seal to be released before the bridges are tom off. In other words, there was a certain limit in improving the strength of the stopper tabs to resist deformation during the opening of a bottle.

SUMMARY OF THE INVENTION

It is an object of the present invention to provide an improved cap incorporating a pilfer-proof function featuring minimal transit resistance while climbing over a bead member, and featuring the capability to securely retain a band member during the process of opening a bottle.

It is another object of the present invention to provide an improved cap incorporating a pilfer-proof function capable of removing the band member that is integrated with the cap itself during the process of opening a bottle.

To achieve the above objects, the present invention provides an improved plastic cap comprising a novel structure described below.

An upper cap body and a lower band member are integrally molded via a plurality of bridges disposed between them.

An annular wall extending upwardly and inwardly is integrally formed with the lower band member on an internal surface of said lower band member.

By inwardly bending an aperture edge of the annular wall in the radial direction, a plurality of stopper tabs are formed on the internal surface of said annular wall by way of projecting away from the annular wall.

The stopper tabs may be formed along the aperture edge of the annular wall by way of forming continuous chevron shapes.

According to the invention, since a plurality of stopper tabs are integrally formed with an annular wall provided on an internal surface of a band member by inwardly bending an aperture edge of the annular wall in the radial direction, a force, acting upon the band member during the process of opening a bottle, can be shared by the annular wall and the stopper tabs. In other words, since the invention increases the load sharing sectional area and provides such a bending structure that can hardly be subject to buckling deformation, the band member can be more securely retained.

When securing the inventive cap to a bottle mouth, the stopper tabs circularly shift themselves in the obliquely downward direction along a bead member. Simultaneously, only the refracted tips of the stopper tabs come into superficial contact with the bead member before receiving a radial-directional outwardly pressing reaction force, thus minimizing contact resistance. Furthermore, the stopper tabs can easily be deformed in the direction to level off the bent shape by causing the pressing reaction force to concentrate onto the bent tip ends thereof, thus minimizing transit resistance while securing the cap onto a bottle mouth.

Alternately, according to the invention, using a pair of wall surfaces that are continuous and substantially perpendicular to the aperture edge of the annular wall and another wall surface partially having circular-arc shape for interlinking the other two wall surfaces, each stopper tab is formed in the "]" shape, and yet, circular-arc domains may be formed between the individual stopper tabs.

When providing the "]" shaped stopper tabs, since a surface wall is externally pressed by the bead member when capping a bottle, the intersectional angle between the two surface walls expands in the circumferential direction to elastically deform the wall surfaces before permitting the stopper tabs to climb over the bead member. In this case, transit resistance generated in the "]" shaped stopper tabs is greater than that of those continuous chevron-type stopper tabs and the below-mentioned sawtoothed type stopper tabs. However, the "]" shaped stopper tabs generate stopper resistance (engaging resistance) that is greater than either of the above-cited continuous chevron-type and the below-mentioned sawtoothed type stopper tabs when opening a bottle.

Preferably, each of the stopper tabs has a sawtoothed shape formed by a surface wall mildly tilting to an upstream side of the cap-closing rotating direction when capping a bottle, and another short-length wall surface extending externally, substantially in the radial direction. It is also permissible for embodying the invention by way of interposing circular-arc domains between the sawtoothed stopper tabs, or by way of continuously providing the sawtoothed stopper tabs.

By virtue of the provision of the sawtoothed stopper tabs, the surface wall mildly tilting to the upstream side of the cap-closing rotating direction when capping a bottle is pressed by the bead member, and then the surface wall elastically deforms by externally expanding in the radial and circumferential directions before smoothly climbing over the bead member. After completing a bottle capping process, the wall surface returns to the original shape while being engaged with the bottom end of the bead member.

The magnitude of transit resistance generated in the course of capping a bottle with the cap incorporating the sawtoothed stopper tabs is slightly higher than that is normally generated by chevron-type stopper tabs. On the other hand, stopper resistance of the sawtoothed stopper tabs in the course of opening the cap is greater than that of the chevron-type stopper tabs, thus advantageously improving the pilfer-proof function. Furthermore, the transit resistance of the cap incorporating the sawtoothed stopper tabs can be lowered to such a degree substantially corresponding to that of the cap incorporating chevron-type stopper tabs by forming a groove at the intersection of one surface wall and another surface wall.

To embody the present invention, using a plurality of bridges each containing frail strength and a durable bridge containing durable strength, the cap body and a band member are connected to each other. A breakable domain is formed in the band member adjoining a location at which the durable bridge is provided. It is so arranged that the breakable domain and the bridges respectively have a breaking strength that is weaker than that of the durable bridge. Since the inventive cap incorporates the band member accommodating a breakable domain adjacent to a location at which the durable bridge is formed, and because the breaking strength of the durable bridge is greater than that of the breakable domain and the bridges, when opening the cap from a sealed bottle, the bridges and the breakable domain are respectively torn off except for the durable bridge that remains unaffected. After the breakable domain is torn off, the band member is disengaged from the bead member. As a result, the band member is eliminated from the bottle mouth because the durable bridge is integrated with the cap body.

According to the cap embodied by the present invention, because there is less transit resistance in the course of the stopper tabs climbing over the bead member, the actual breaking strength of the bridges can be arranged to be lower than that of conventional caps, thus saving the force needed to open up the sealed cap. Furthermore, since the band member can securely be prevented from shifting upward by way of solidly securing the band member with stopper tabs and annular walls, it is possible for the inventive cap to expedite the moment to break off the plurality of bridges. This will effectively help prevent faulty bottled products from easily being generated or otherwise caused by incidental mischief, for example. In consequence, the invention can provide useful caps capable of securely exerting pilfer-proof function as a whole.

Since the band member can also be torn off simultaneously with the breaking of small bridges during the course of opening a sealed bottle, the band member can be removed from the bottle together with the cap body.

The above and further objects and features of the invention will more fully be apparent from the following detailed description given in reference to the first through fifth embodiments and the accompanying drawings including FIGS. 1 through 11 which are merely shown by way of example.

DETAILED DESCRIPTION OF THE INVENTION

FIGS. 1 through 6 respectively illustrate the structure of the inventive cap according to the first embodiment.

Figure 1A:
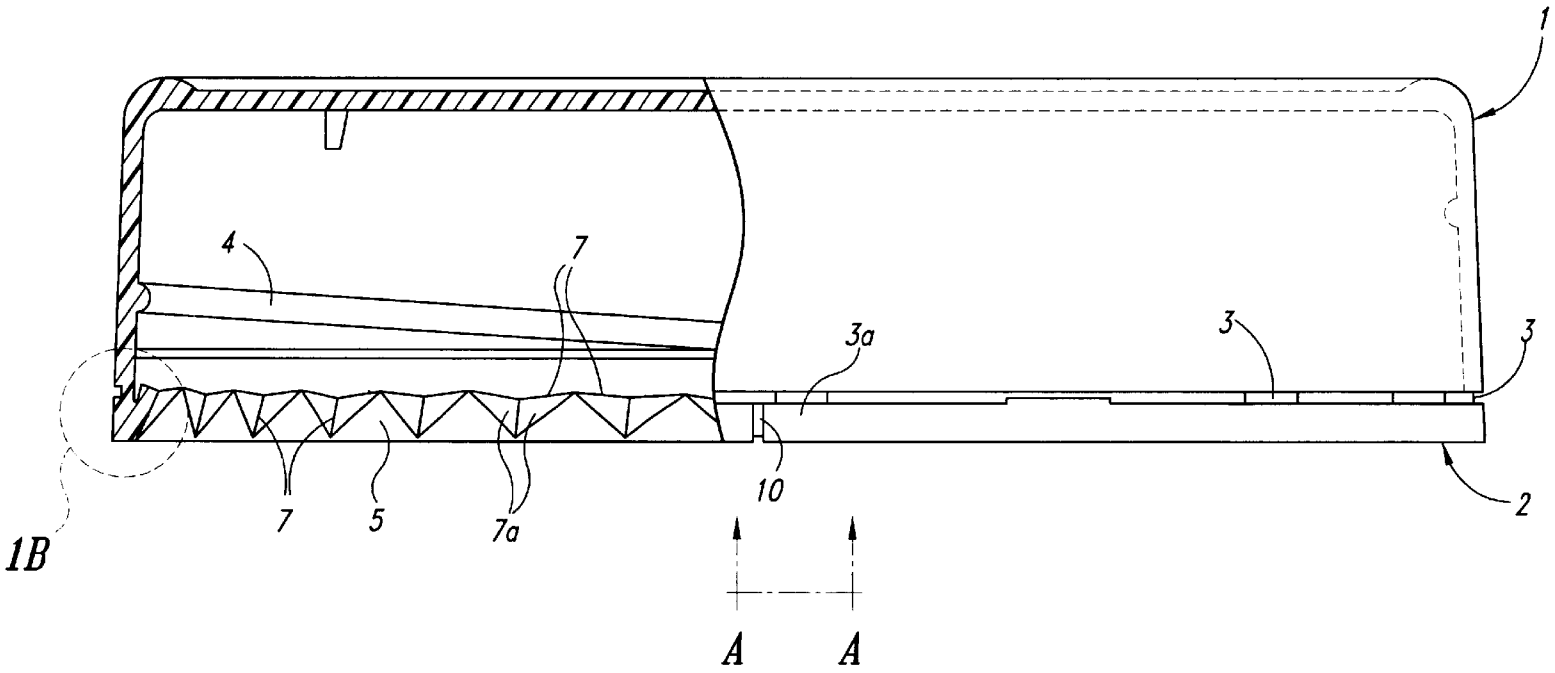
FIG. 1A is a partially exposed front view of the inventive cap.
Figure 1B:
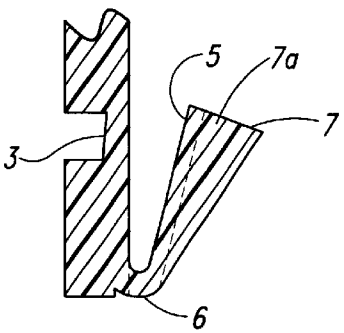
FIG. 1B is an enlarged sectional view of a portion of the cap as indicated in FIG. 1A.

The inventive cap shown in FIGS. 1 comprises an upper cap body 1 and a lower band member 2 disposed in opposition from the cap body 1 via minimal clearance. The cap body 1 and the band member 2 are integrally linked with each other by means of 8 units of bridges 3 and 3*a* formed via a plastic molding process. Screw threads 4 are formed on the internal surface of the cap body 1. Those bridges 3 and 3*a* are circumferentially disposed at equal intervals. Of these 8 units of bridges 3 and 3*a*, 7 units consist of a fine bridge 3 each having a narrow width and breakable strength, whereas the remaining one unit consists of a bridge 3*a* having durable strength and a width wider than that of the fine bridges 3.

The band member 2 is of a ring shape, which is integrally formed together with an annular wall 5 that extends upwardly and radially inwardly from a bottom portion of an inner surface of the band member. The annular wall 5 integrally is connected to the band member 2 by a base 6 extending therebetween, such that the band member 2, the base 6, and the annular wall 5 are interconnected to form a structure having a V-shape or hook-shaped cross-section as shown in FIG. 1. The entire surface of the annular wall 5 obliquely extends upwardly and is tapered off. As shown in FIG. 1, for example, the thickness of the annular wall 5 according to the first embodiment is constant and is the same as the thickness of the base 6. However, the thickness of the annular wall 5 may be arranged to differ from that of the base 6.

Figure 2A:
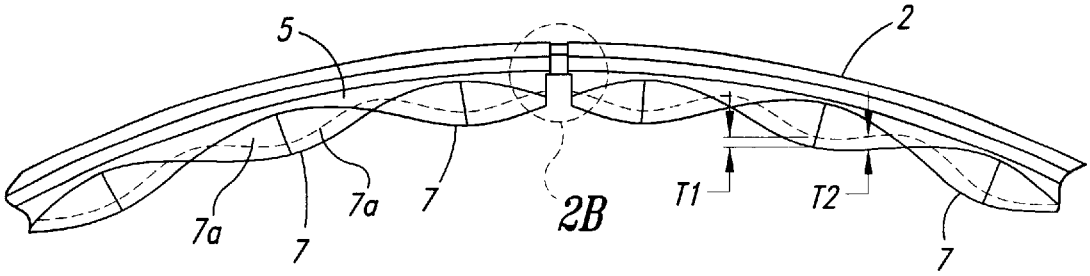
FIG. 2A is an enlarged sectional view across line A—A shown in FIG. 1.
Figure 2B:
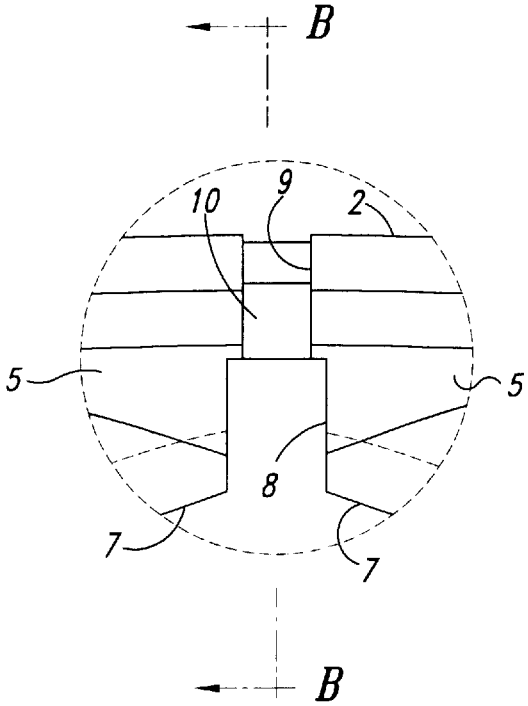
FIG. 2B is an enlarged view of the area indicated in FIG. 2A.

A plurality of stopper tabs 7 are formed in the annular wall 5 in order to securely retain the band member 2 at the bottle mouth. More particularly, by inwardly bending an aperture edge of the annular wall 5 in the radial direction, the stopper tabs form continuous chevrons. Each of these stopper tabs 7 consists of a pair of triangular surface walls 7*a*, where a ridge line 100 of a pair of surface walls 7*a* and a border line 102 between the annular wall 5 and both surface walls 7*a* converge at the base 6 in order that the tip of the ridge line projects inwardly in the radial direction above other levels. As shown in FIG. 2, the thickness TI of the ridge line 100 is slightly thinner than the thickness T2 of the surface wall 7*a*. The reason for this is described in greater detail below.

After the cap is secured on the bottle mouth, when the cap body 1 is then turned in a direction to remove the cap and open the bottle, the bridge 3 is torn off to cause the band member 2 to remain around the periphery of bottle mouth. With this kind of cap, by manually putting the cap body 1 back onto the bottle mouth and positioning the tom-off bridge 3 adjacent to the cap body 1, the bridge 3 can be made to look as it does when normally linked with the cap body 1. In order to prevent such intentional abuse of the cap from occurring, it is desirable that the band member 2 be torn off when unscrewing the cap body 1, so that the band member 2 can be removed from the bottle mouth.

Figure 3:
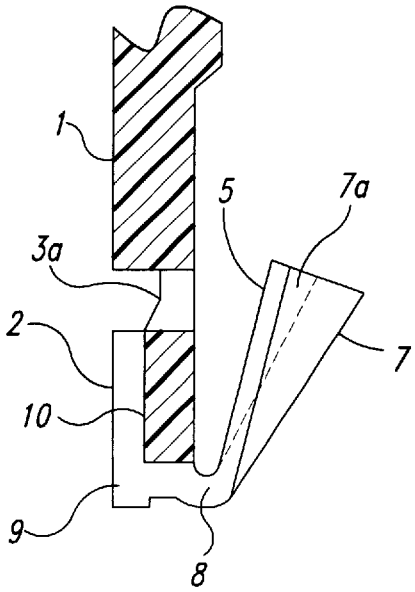
FIG. 3 is an enlarged sectional view across line B—B shown in FIG. 2B.

More particularly, as shown in FIGS. 2 and 3, the annular wall 5 is split by means of a groove 8 at the band member 2 and the groove is adjacent to a point at which the bridge 3*a* (FIG. 3) having durable break strength is formed. In addition, a recessed domain 9 is connected to the groove 8 and is formed in the band member 2. An easily breakable break domain 10 is provided between the groove and the recessed domain 9.

According to the first embodiment shown in the related drawings, the breaking strength of the breakable domain 10 is greater than the breaking strength of the bridges 3 and less than the breaking strength of the bridge 3*a*. However, the breaking strength of the breakable domain 10 may also be less than the breaking strength of the plurality of bridges 3.

Figure 4B:
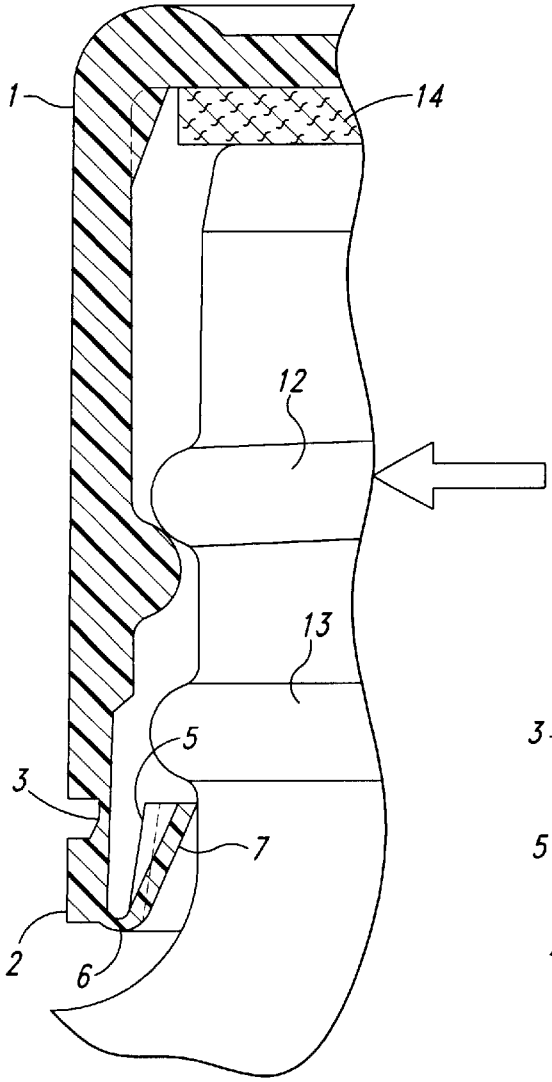
FIGS. 4A and 4B are enlarged sectional views of the inventive cap representing sequential processes for mounting the cap.
Figure 4A:
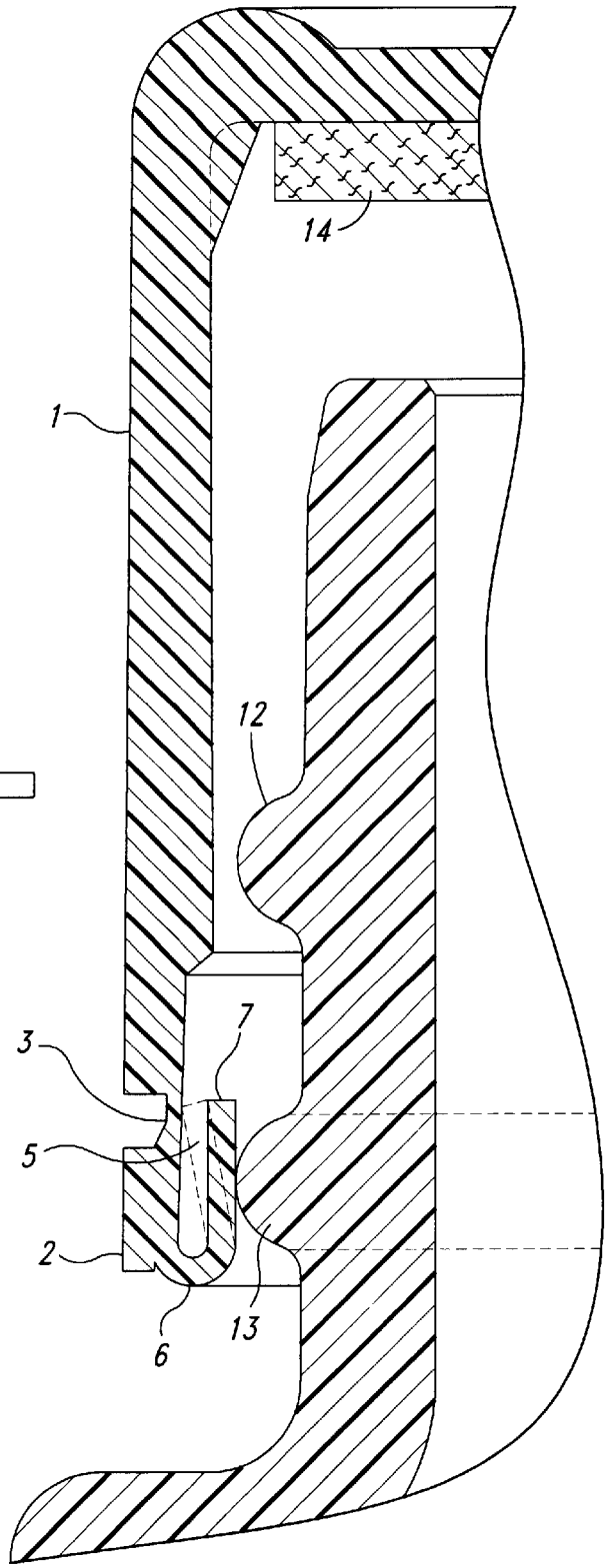
Figure 5:
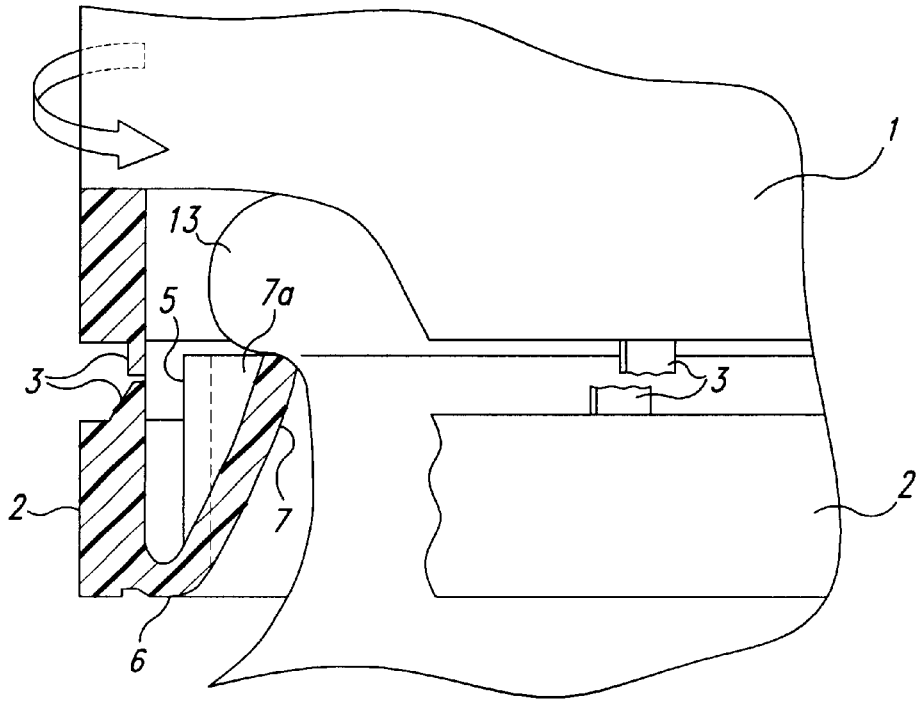
FIG. 5 is a partially exposed front view of the inventive cap representing the opened state thereof.

The cap is secured onto a bottle mouth via the sequential steps shown in FIG. 4. The reference numeral 12 shown in FIG. 4 designates screw threads formed on the bottle mouth. The reference numerals 13 and 14 shown in FIG. 4 respectively designate a bead member and a packing.

After putting the cap on the bottle mouth, the cap body 1 is screwed onto the bottle mouth. As the cap body 1 is screwed onto the bottle mouth, a plurality of the stopper tabs 7 on the internal surface of the band member 2 come into contact with the bead member 13, and the bead member 13 exerts a pressing reaction force against the stopper tabs. All of the stopper tabs 7 move circumferentially in an obliquely prone manner. In the course of moving circumferentially, because the stopper tabs 7 continuously bend chevron-wise, they can easily be subject to elastic deformation in the radially outward direction, like bellows for example, and yet, because the thickness T1 of the ridge line is thinner than the thickness T2 of the surface wall 7*a*, the stopper tabs 7 can easily be deformed even when receiving the slightest amount of the pressing reaction force. Furthermore, only the ridge line at the tip of bent stopper tabs 7 comes into contact with the bead member 13. Minimal contact resistance and concentration of pressing reaction force onto the tip of the bent stopper tabs 7 facilitate elastic deformation of the stopper tabs 7, thereby minimizing transit resistance of the stopper tabs 7 when climbing over the bead member 13.

Accordingly, the bridges 3 can securely be prevented from being torn off, which is caused by the function of an excessive tensile force incurred on the bridges in the course of securing the cap onto the bottle mouth.

After climbing over the bead member 13, the stopper tabs 7 return to the upwardly inclined posture, and the elasticity of the stopper tabs cause the tips of the bent upper edges to securely engage the base on the bottom surface of the bead member 13. Simultaneously, while being pressed against the ceiling wall of the cap body 1, the packing 14 elastically deforms to closely adhere to the peripheral wall of the bottle mouth.

When the cap body 1 is turned to open the bottle, a tensile force along the circumferential direction acts upon the bridges 3 and 3*a*. In addition, a lifting force acts upon the band member 2. The lifting force also acts upon the stopper tabs 7 as a buckling load. However, all the stopper tabs 7 bend by way of the chevron shape in the section, thus forming a reinforced structure that can hardly be subject to buckling deformation. Furthermore, since the stopper tabs 7 are integral with the annular wall 5, the buckling load is cooperatively shared by the stopper tabs 7 and the annular wall 5. Furthermore, the deformation strength of the base 6 is reinforced by arranging the thickness of the base 6 to be substantially equal to the thickness of the surface wall 7*a*. In consequence, even when turning the cap body 1 to open the bottle, the band member 2 can securely be held in position without shifting upward, thus facilitating an early break of the bridges 3. (See FIG. 5)

Figure 6:
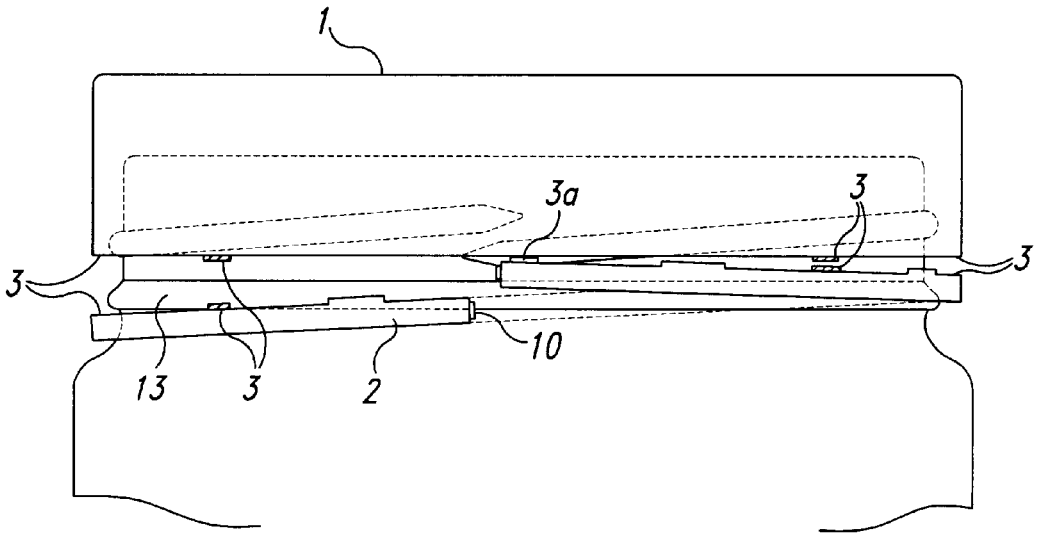
FIG. 6 is a front view of breakable domain of the inventive cap representing the broken state thereof.

Even after all the bridges 3 are torn off, the other bridge 3*a* having a durable breaking strength still remains unaffected. As a result, the opening force acting upon the cap body 1 concentrates at the bridge 3*a*. The breakable domain 10 on the part of the band member 2 is connected to the bridge 3*a*. Since the breaking strength of the breakable domain 10 is less than the breaking strength of the bridge 3*a*, a break line is generated in the local domain adjacent to the bridge 3*a*, and the break line grows in the direction of the breakable domain 10. Finally, as shown in FIG. 6, the break line cuts the band member 2 at the breakable domain 10. The groove 8 described earlier helps facilitate disconnection of the band member 2. After being split, the entire band member 2 becomes loose, and causes the stopper tabs 7 to be disengaged from the bead member 13, and thus, the split band member 2 is removed from the bottle mouth because it is integrated with the cap body 1 by the bridge 3*a*. Therefore, even though a person attempts to recap the bottle mouth with the removed cap body 1, viewers can identify that the cap was already opened because the band member is broken off and hanging downwardly from the cap body.

Figure 7:
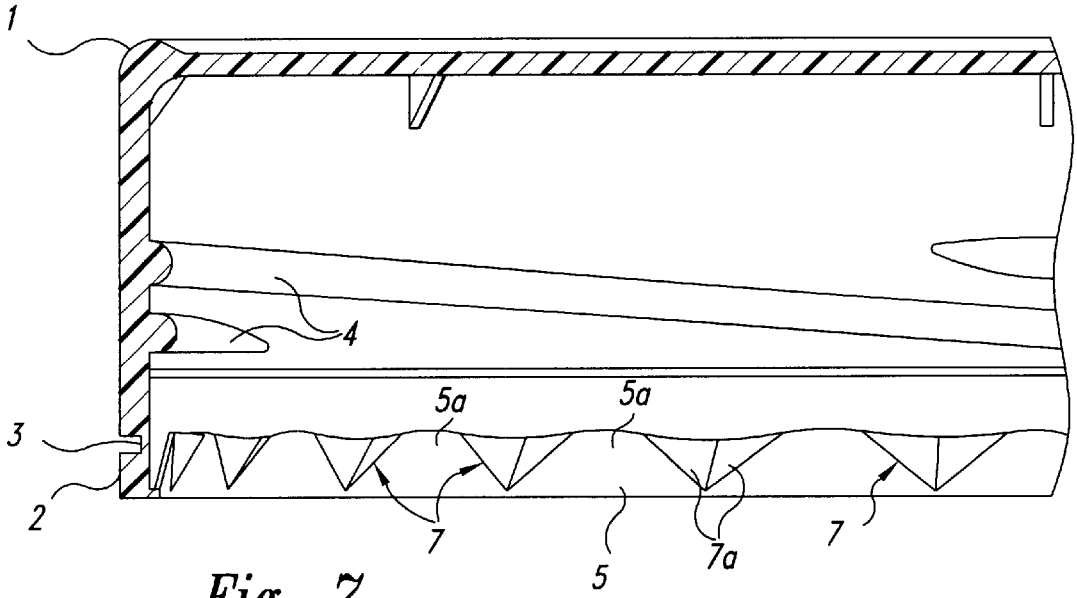
FIG. 7 is a sectional view of the cap according to the second embodiment of the invention.
Figure 8:
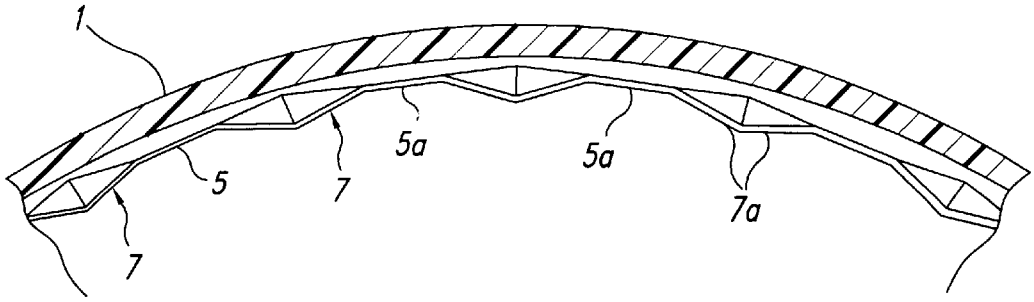
FIG. 8 is a sectional view of the inventive cap across line C—C shown in FIG. 7.

FIGS. 7 and 8, respectively, designate the second embodiment of the inventive pilfer-proof cap by way of varying the state of disposing the stopper tabs 7. To implement the second embodiment, a circular-arc portion 5*a* and each stopper tab 7 are alternately formed such that the aperture edge of the annular wall 5 can remain in the form of circular-arc, thus decreasing the number of the disposed stopper tabs 7. Except for this difference, all of the structures of the second embodiment are identical to those of the cap in accordance with the first embodiment.

Figure 9A:
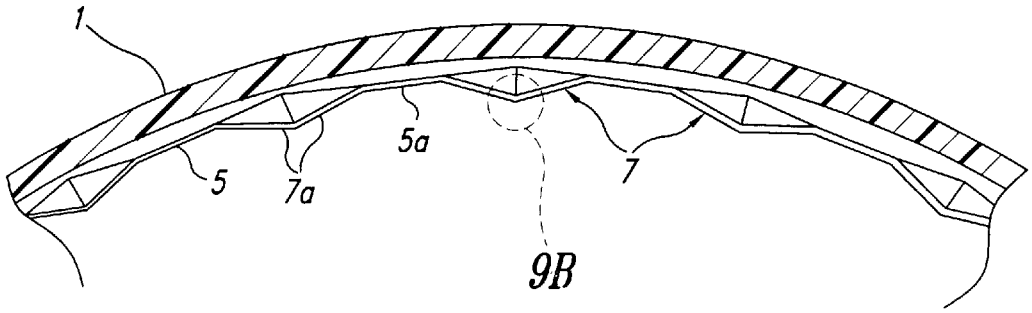
FIG. 9A is a transverse plan representing the stopper tabs according to the third embodiment of the invention.
Figure 9B:
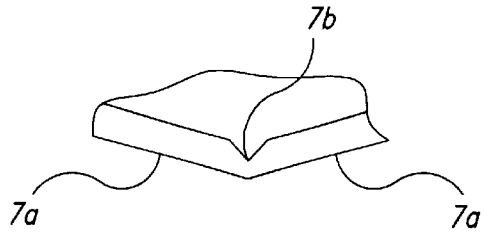
FIG. 9B is an enlarged view of the area indicated in FIG. 9A.
Figure 10:
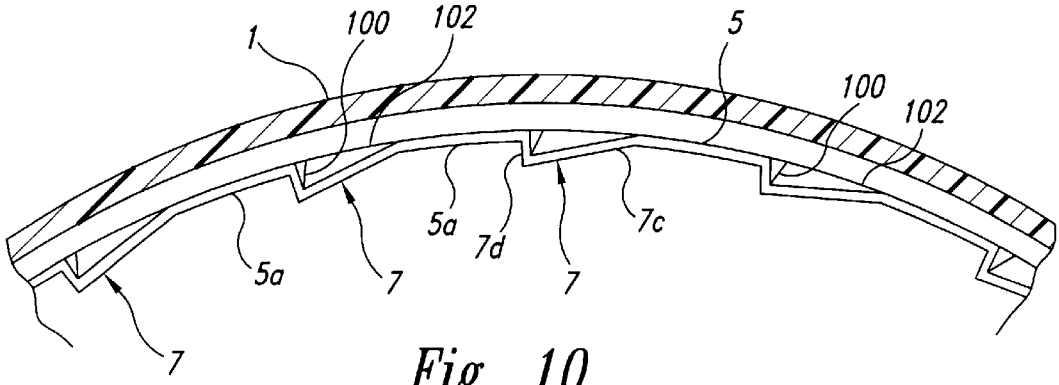
FIG. 10 is a transverse plan representing the stopper tabs according to the fourth embodiment of the invention.
Figure 11:
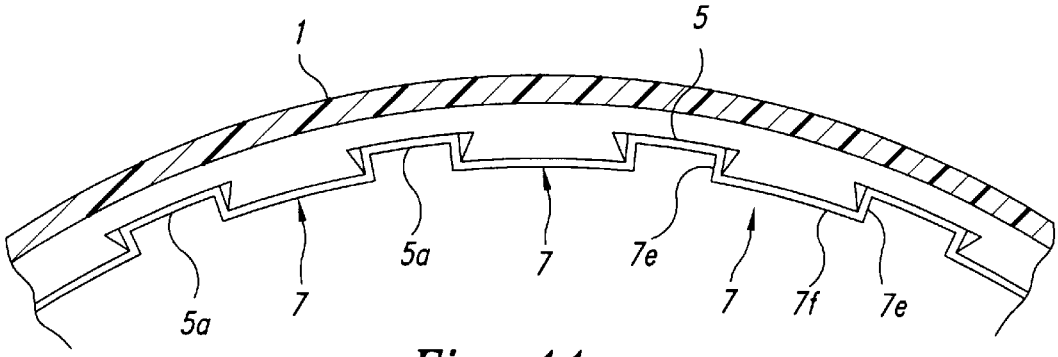
FIG. 11 is a transverse plan representing the stopper tabs according to the fifth embodiment of the invention.

FIGS. 9 through 11, respectively, designate further embodiments of the inventive pilfer-proof cap by way of varying plan-view configuration of the stopper tabs 7. To implement the third embodiment shown in FIGS. 9, in the same way as was done for the second embodiment, stopper tabs 7 are intermittently formed. In addition, the thickness of the stopper tabs 7 is reduced by forming a groove 7*b* at a local domain adjacent to a pair of the surface walls 7*a* and 7*a*, thus allowing the stopper tabs 7 to easily deform outward in the radial direction As a matter of course, such a groove 7*b* may also be provided for the stopper tabs 7 of the first embodiment.

To implement the fourth embodiment shown in FIG. 10, a surface wall 7*c*, mildly inclined at a leading side of the stopper tab with respect to the rotational direction in which the cap moves in the course of screwing the cap onto the bottle mouth, and a short surface wall 7*d*, extending externally substantially in the radial direction, are respectively formed to define sawtoothed stopper tabs 7.

As was done for the second embodiment, the fourth embodiment shown in FIG. 10 has circular-arc domains 5*a* between the stopper tabs 7. However, as was done for the first embodiment, the stopper tabs 7 may also be provided in succession.

To implement the fifth embodiment shown in FIG. 11, each of the stopper tabs 7 is formed by way of a "]" shape by combining a pair of surface walls 7*e*, which are continuous and substantially perpendicular to the aperture edge of the annular wall 5, with another surface wall 7*f* having a circular-arc local domain. The tip ends of the surface walls 7*e* are connected, thus providing a circular-arc domains 5*a* between all of the stopper tabs 7.

As was described earlier in relation to the first embodiment, in addition to thinning the breakable domain 10 by providing a recessed domain 9 or a groove 8, the breakable domain 10 may also be formed by providing the band member 2 with machine-sewn frail portion. The annular wall 5 may also be of such a structure as the one upwardly projecting from the halfway area of the vertical-directional inner wall surface of the band member 2.

What is claimed is:

1. A pilfer-proof plastic cap comprising:

an internally screw-threaded upper cap body;

a lower band member;

a plurality of bridges;

an annular wall; and a plurality of stopper tabs;

wherein said upper cap body and said lower band member are integrally molded together with said plurality of bridges interposed between said cap body and said lower band member, said annular wall extends axially upwardly and radially inwardly from said lower band member and is integrally formed with said lower band member, said plurality of stopper tabs project inwardly from said annular wall, each being formed by an inwardly bending portion of said annular wall, bent in the radial direction so that each of the stopper tabs consists of a pair of triangular surface walls defined by a ridge line between the pair of walls and border lines converging at a base where the annular wall is connected to the lower edge of the band member;

characterized in that each stopper tab of said plurality of stopper tabs is respectively formed in constantly-decreasing sawtoothed cross section from an upper edge of said annular wall to a fold line, along which said annular wall and said band member are joined, with one of said triangular surface walls, which is leading in the cap-closing direction of rotation when screwing said cap to a bottle mouth, being of shallow inclination, and the other said triangular surface wall comprising a surface wall of short radial length relative to the circumferential length of said one of said triangular surface walls extending substantially in the radial direction.

2. The pilfer-proof cap according to claim 1, wherein said upper cap body is connected to said lower band member by a bridge having a durable breaking strength and by a plurality of fine bridges, said bridge interconnecting said upper cap body and said lower band member and having a breaking strength, wherein a breakable domain is formed in a local domain of said lower band member adjacent to said bridge, and wherein said breakable domain and said plurality of fine bridges each have a breaking strength lower than the durable breaking strength of said bridge.

3. The pilfer-proof cap according to claim 2 wherein said first and second surface walls have an angled surface adjacent to the ridge line, the ridge line having a thickness less than the thickness of the first and second surface walls.

* * * * *